US008633857B2

(12) United States Patent
Wang et al.

(10) Patent No.: US 8,633,857 B2
(45) Date of Patent: Jan. 21, 2014

(54) ANTENNA STRUCTURE

(75) Inventors: Yang-Kai Wang, TamShui (TW); Chien-Hung Chen, TamShui (TW); Shu-An Yeh, TamShui (TW); Yu-Chang Lai, TamShui (TW)

(73) Assignee: Advanced Connection Technology, Inc., TamShui (TW)

( * ) Notice: Subject to any disclaimer, the term of this patent is extended or adjusted under 35 U.S.C. 154(b) by 567 days.

(21) Appl. No.: 12/917,527

(22) Filed: Nov. 2, 2010

(65) Prior Publication Data

US 2012/0050123 A1 Mar. 1, 2012

(30) Foreign Application Priority Data

Aug. 25, 2010 (TW) ..... 99128443 A
Aug. 25, 2010 (TW) ..... 99216360 U

(51) Int. Cl.
*H01Q 1/38* (2006.01)

(52) U.S. Cl.
USPC ..... 343/700 MS; 343/767; 343/872

(58) Field of Classification Search
USPC ..... 343/700, 702, 767, 872
See application file for complete search history.

(56) References Cited

U.S. PATENT DOCUMENTS

| | | | | |
|---|---|---|---|---|
| 5,087,920 | A * | 2/1992 | Tsurumaru et al. | 343/700 MS |
| 6,552,685 | B2 * | 4/2003 | Zhang | 343/700 MS |
| 6,593,891 | B2 * | 7/2003 | Zhang | 343/767 |
| 2004/0201531 | A1 | 10/2004 | Fujimura et al. | |
| 2005/0017914 | A1 | 1/2005 | Huang | |
| 2010/0141535 | A1 | 6/2010 | Chen et al. | |

FOREIGN PATENT DOCUMENTS

| | | | |
|---|---|---|---|
| EP | 0 384 777 | A2 | 8/1990 |
| EP | 0 891 004 | A1 | 1/1999 |
| JP | 2-168703 | A | 6/1990 |
| JP | 9-74312 | A | 3/1997 |

* cited by examiner

*Primary Examiner* — Tho G Phan
(74) *Attorney, Agent, or Firm* — Dittavong Mori & Steiner, P.C.

(57) ABSTRACT

An antenna structure includes a substrate, a radiation unit, and a metal plate. The radiation unit is disposed on the substrate. The metal plate is separated from the radiation unit for a distance and is electrically isolated with the radiation unit. The metal plate is excited by the radiation unit to generate at least one resonance mode, and includes a hole penetrating the metal plate. Thus, the gain is enhanced, the bandwidth is increased, and multiple resonance modes are provided.

9 Claims, 8 Drawing Sheets

ANTENNA STRUCTURE

CROSS-REFERENCES TO RELATED APPLICATIONS

This non-provisional application claims priority under 35 U.S.C. §119(a) on Patent Application No. 99128443 filed in Taiwan, R.O.C. on 2010 Aug. 25, the entire contents of which are hereby incorporated by reference.

BACKGROUND OF THE INVENTION

1. Technical Field

The present invention relates to an antenna structure, and more particularly to an antenna structure capable of enhancing the radiation effect of the entire antenna.

2. Related Art

With the development of wireless communication technologies, many wireless communication devices, such as mobile phones, notebook computers, personal digital assistants (PDAs), GPS Satellite Navigation Systems, and E-book readers, have been developed. Aside from wireless communication functions, by replacing a conventional external antenna with an embedded antenna, the wireless communication devices can be built with an attractive, light, and thin industrial design while having a good quality of wireless communication.

However, in order to ensure an attractive design with accompanying sensation of quality, the housing of electric devices is expected to be made of metal, or be plated with a metal layer, influences the quality of wireless communication. Due to the shielding effect of metal, the delivery of electromagnetic waves is blocked, and antenna signal quality suffers.

FIG. 1 is a schematic view of a conventional wireless communication device 1*a*. Presently, in order to solve the above problem a housing 12*a* must have a non-metal portion 122*a* and a metal portion 124*a*. The non-metal portion 122*a* is made of a non-metal material such as plastic and carbon fiber, so that electromagnetic waves may be received by an antenna (not shown), in the housing 12*a* through the non-metal portion 122*a*, or electromagnetic waves radiated by the antenna may be radiated out through a hole 14*a*.

FIG. 2 is a schematic view of US Patent Application Publication No. 20100141535. Please refer to FIG. 2, in which a metal sheet 24*a* is disposed on a housing 22*a* of an electronic device 2*a* to improve the field pattern and the average gain of an antenna 26*a* in the housing 22*a*. However, the metal sheet 24*a* must avoid being overlapped excessively with the antenna 26*a*, otherwise it is not possible to improve the efficacy of antenna gain, and the shielding effect described above will result.

SUMMARY

Accordingly, the present invention is directed to an antenna structure so as to enhance the antenna gain and increase the bandwidth or provide multiple modes. The present invention is further directed to an antenna structure so as to enable an electronic device to have pleasing housing without reducing the gain of the antenna when being applied in the electronic device.

An antenna structure is provided, which includes: a substrate; a radiation unit, disposed on the substrate; and a metal plate, separated from the radiation unit for a distance and electrically isolated with the radiation unit. The metal plate is excited by the radiation unit to generate at least one resonance mode, and the metal plate includes a hole penetrating the metal plate.

An antenna structure is provided, which includes: a radiation unit; and a metal cover, including a concave surface and a convex surface. The concave surface faces the radiation unit. The metal cover is electrically isolated with the radiation unit and is excited by the radiation unit to generate at least one resonance mode. The metal cover includes a hole penetrating the concave surface and the convex surface.

Preferred embodiments and effects of the present invention are illustrated below with reference to the accompanying drawings.

BRIEF DESCRIPTION OF THE DRAWINGS

The present invention will become more fully understood from the detailed description given below for illustration only, and thus not limitative of the present invention, wherein.

DETAILED DESCRIPTION

Figure 1:
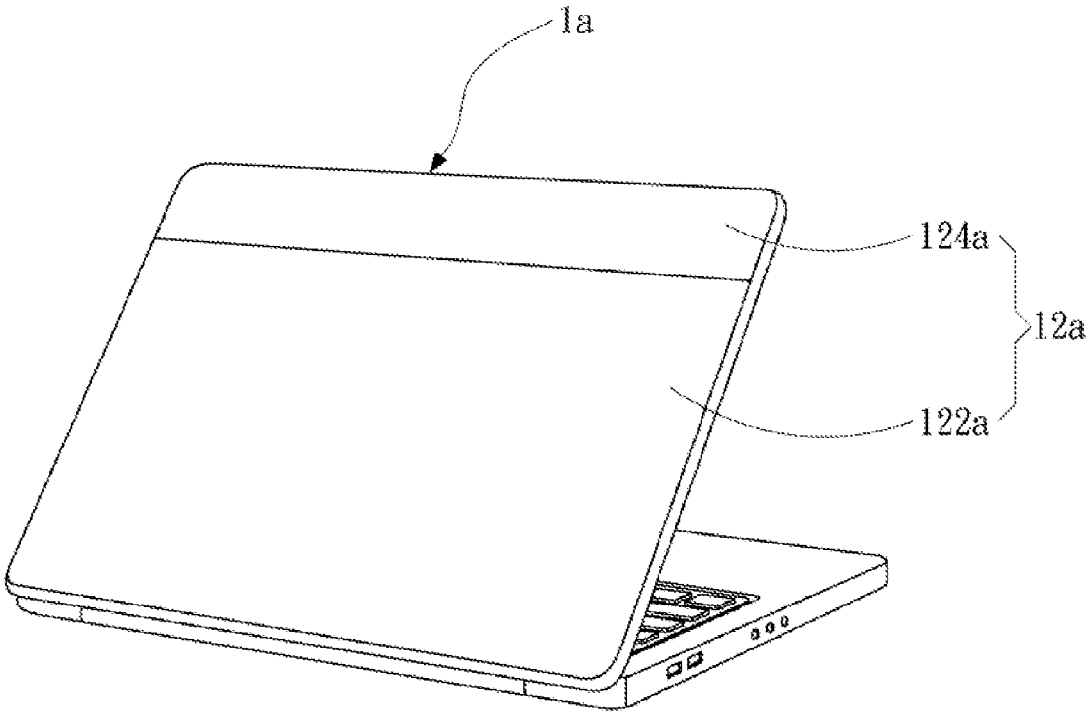
FIG. 1 PRIOR ART
FIG. 1 is a schematic view of a conventional communication unit.
Figure 2:
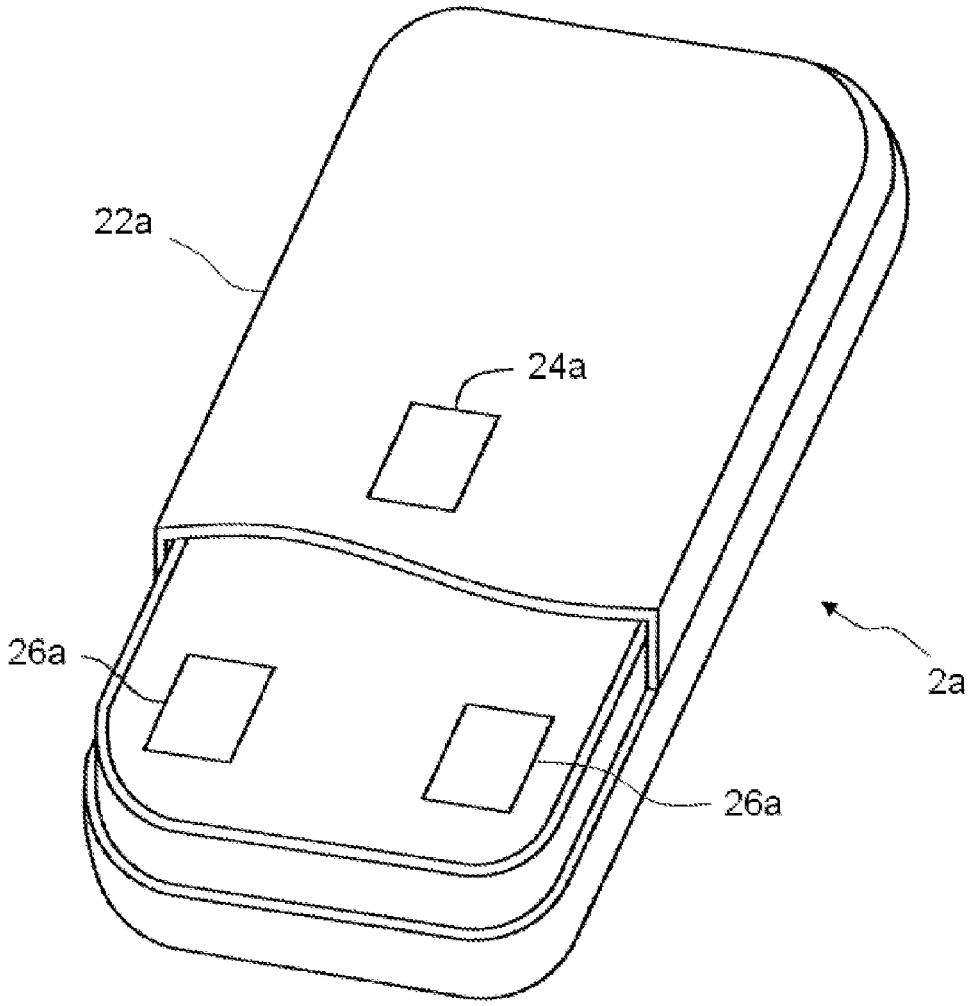
FIG. 2 PRIOR ART
FIG. 2 is a schematic view of US Patent Application Publication No. 20100141535.

Hereafter embodiments are exemplified to illustrate the present invention in detail with reference to the accompanying drawings. For numbers mentioned in the specification, please make reference to the reference numbers in the drawings.

Figure 3:
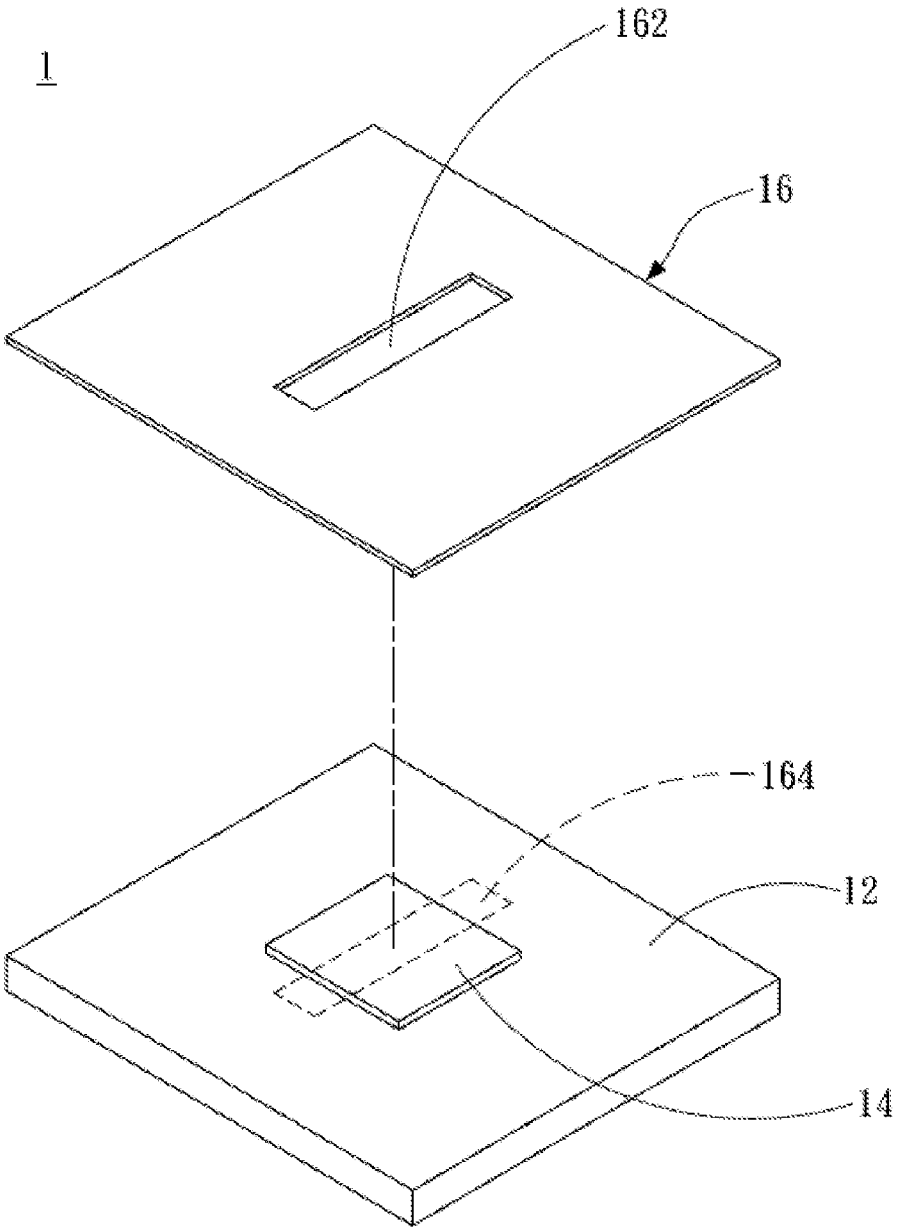
FIG. 3 is a schematic view of a first embodiment of the present invention.
Figure 4:
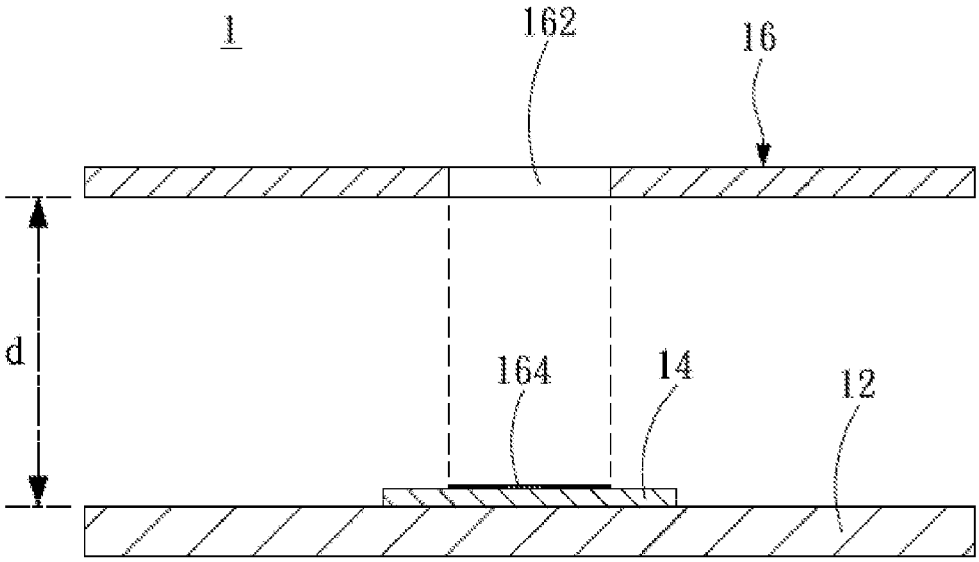
FIG. 4 is side view of the first embodiment of the present invention.

FIG. 3 is a schematic view of a first embodiment of the present invention, and FIG. 4 is a side view of the first embodiment of the present invention. Please refer to FIGS. 3 and 4, in which the first embodiment provides an antenna structure 1. The antenna structure 1 includes a substrate 12, a radiation unit 14, and a metal plate 16. The radiation unit 14 is disposed on the substrate 12. The metal plate 16 is separated from the radiation unit 14 for a distance d, and is electrically isolated with the radiation unit 14. A capacity effect is generated between the metal plate 16 and the radiation unit 14. In the manner of energy coupling, the metal plate 16 is excited by the radiation unit 14, such that the antenna structure 1 generates at least one resonance mode. The metal plate 16 includes a hole 162 penetrating the metal plate 16, and the metal plate 16 cannot be fed with any electric signal or be grounded.

When the radiation unit 14 radiates electromagnetic wave signals, the metal plate 16 having the hole 162 couples the electromagnetic wave signals, and sends the electromagnetic wave signals with a radiation area larger than the radiation unit 14. Therefore, the gain of the radiation unit 14 is increased, and the quality of communication is improved. On the other hand, when receiving the electromagnetic wave signals, the metal plate 16 provides a larger area to receive the electromagnetic wave signals, and thus the quality of the signals are improved. The metal plate 16 couples the electromagnetic wave signals to the radiation unit 14 and converts the electromagnetic wave signals into electric signals. Here, the radiation unit 14 must be separated from the metal plate 16 for a distance d, so as to prevent the two being too far away from each other to couple the electromagnetic wave signals; or the two are too close to each other such that the radiated electromagnetic wave signals has a strength exceeding the official standard.

The shape of the hole 162 may be a geometrical shape, such as circle and square, and may also be an irregular shape, for example, be designed to a shape of a trademark. The hole 162 cannot be connected to edges of the metal plate 16, that is, the hole 162 must be a hole with closed surroundings. The hole 162 is projected orthogonally to the substrate 12 to form a projection part 164, and at least part of the projection part 164 is overlapped with the radiation unit 14. The radiation unit 14 is selected from a group consisting of a microstrip antenna, a slot antenna, a monopole antenna, a dipole antenna, a patch antenna, a loop antenna, and an array antenna.

Furthermore, the antenna structure 1 further includes a fixing member (not shown), which is connected to at least one of the substrate 12 and the metal plate 16, so as to maintain a distance between the metal plate 16 and the radiation unit 14. Here, the fixing member may be member for supporting and fixing the substrate 12 or the metal plate 16, such as, a support, a screw stud, and a screw thread. Moreover, when the antenna structure 1 is applied in an electronic device the metal plate 16 may be connected to a housing of the electronic device or become a part of the housing. The material of the metal plate 16 may be magnesium, aluminum, stainless steel, or an alloy thereof.

Figure 5:
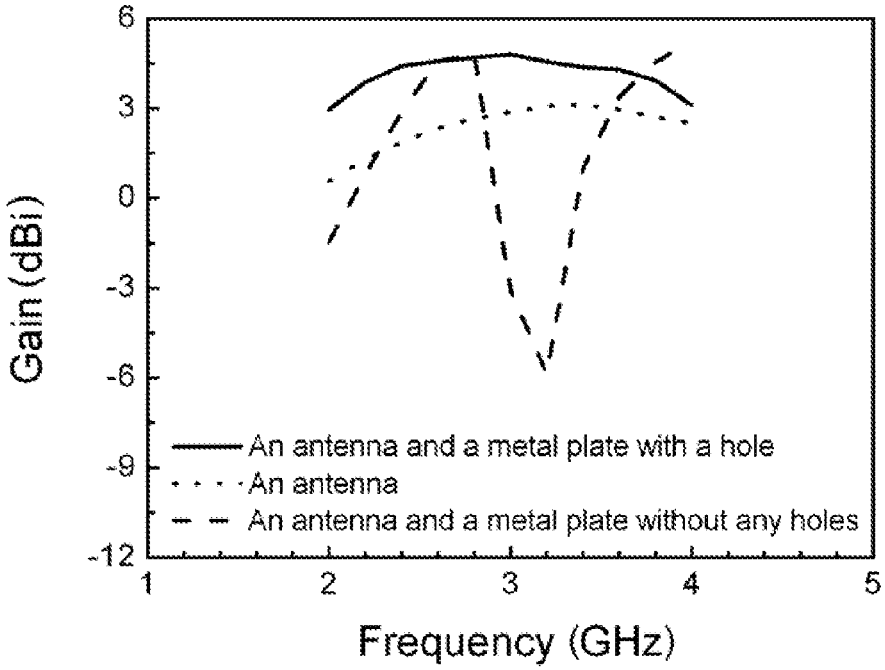
FIG. 5 is a gain comparison view of the first embodiment of the present invention.

FIG. 5 is a gain comparison view of the first embodiment, in which comparison is performed on the gain charts of only a radiation unit 14 and a radiation unit 14 in cooperation with a metal plate without a hole. It can be seen that although in the frequency bands of 2 GHz-4 GHz, 2.2 GHz-2.9 GHz, and 3.6 GHz-4 GHz, the metal plate without a hole is helpful to increase the gain, in the frequency band of 2.9 GHz-3.6 GHz, the gain is reduced significantly. However, the antenna structure 1 of the present invention can improve the gain significantly in the frequency band of 2 GHz-4 GHz. It can be seen that the antenna structure 1 of the present invention actually has good communication capability.

Figure 6:
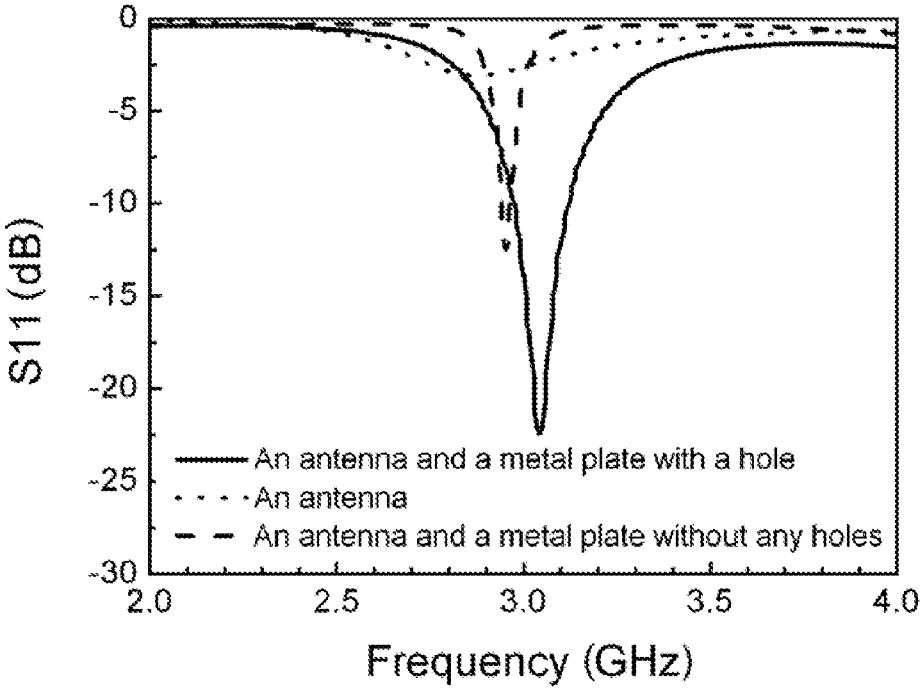
FIG. 6 is a return loss comparison view of the first embodiment of the present invention.

FIG. 6 is a return loss comparison view of the first embodiment of the present invention, in which a comparison is performed on the gain charts of the radiation unit 14 and the radiation unit 14 in cooperation with a metal plate without a hole. It can be seen that, although the metal plate without a hole is added above the radiation unit 14, and the return loss in the frequency band of 2.8 GHz-3 GHz is reduced, the return loss in other frequency band is higher than that of the radiation unit 14. On the contrary, the antenna structure 1 of the present invention reduces the return los in the frequency band of 3.7 GHz-4 GHz, especially at a frequency of 3.05 GHz, the antenna structure 1 of the present invention reduces the return loss to −22 dB. This further indicates that the antenna structure 1 of the present invention actually has good communication capability.

Compared with a single radiation unit 14, when the antenna structure 1 of the present invention is added with the metal plate 16, a capacity effect is generated between the radiation unit 14 and the metal plate 16, and a good resistance match is obtained. Therefore, at least one resonance mode is generated, and the resonance mode can provide a larger bandwidth and gain.

Here, the radiation unit 14 in FIGS. 5 and 6 are the same. In order to clearly indicate the efficacy of the antenna structure 1 of the present invention, compared with the difference of only the radiation unit 14 or the radiation unit 14 in cooperation with a metal plate, a microstrip antenna is taken as an example for measurement, but the present invention is not limited thereto.

Figure 7:
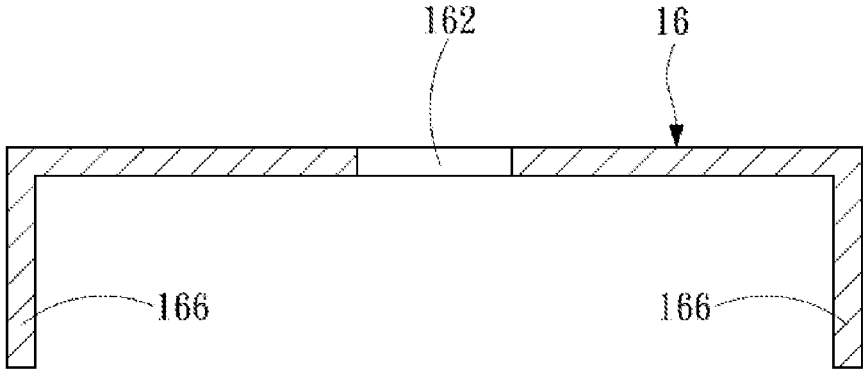
FIG. 7 is a side view of a second embodiment of the present invention.

FIG. 7 is a side view of a second embodiment of the present invention. Like the antenna structure 1 according to the first embodiment of the present invention, a metal plate 16 may further have at least one side plate 166 extended, for example, two opposite sides of the metal plate 16 have two side plates 166 extended to form a U shape in side view. Alternatively, only one side plate 166 extends and forms an L shape (not shown) in side view. Moreover, the metal plate 16 may be, for example, but not limited to, a geometrical shape, such as square and circle, or other irregular shapes.

Figure 8:
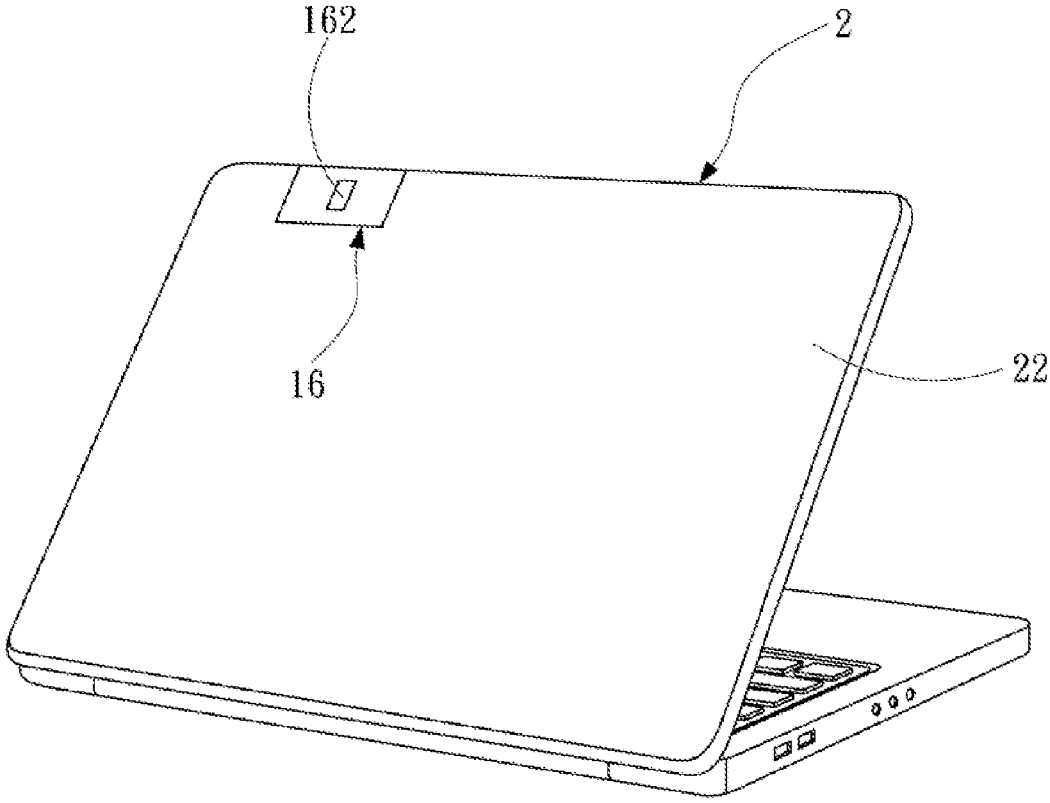
FIG. 8 is a schematic view of a third embodiment of the present invention.

FIG. 8 is a schematic view of a third embodiment of the present invention. A notebook computer 2 is taken as an example to illustrate how to apply the antenna structure of the present invention. The metal plate 16 may be a part of a back housing 22 of the notebook computer 2. The material of the back housing 22 may be plastic, carbon fiber, or magnalium, and the metal plate 16 may be connected to the back housing 22 in an embedding manner. A radiation unit (not shown), of the notebook computer 2 is generally disposed inside the back housing 22 above the screen, and the metal plate 16 is disposed above the radiation unit and is combined with the back housing 22, such that the gain of the radiation unit is improved, and a desired figure of the product is obtained. Here, the metal plate 16 and the back housing 22 may also be formed integrally.

Figure 9:
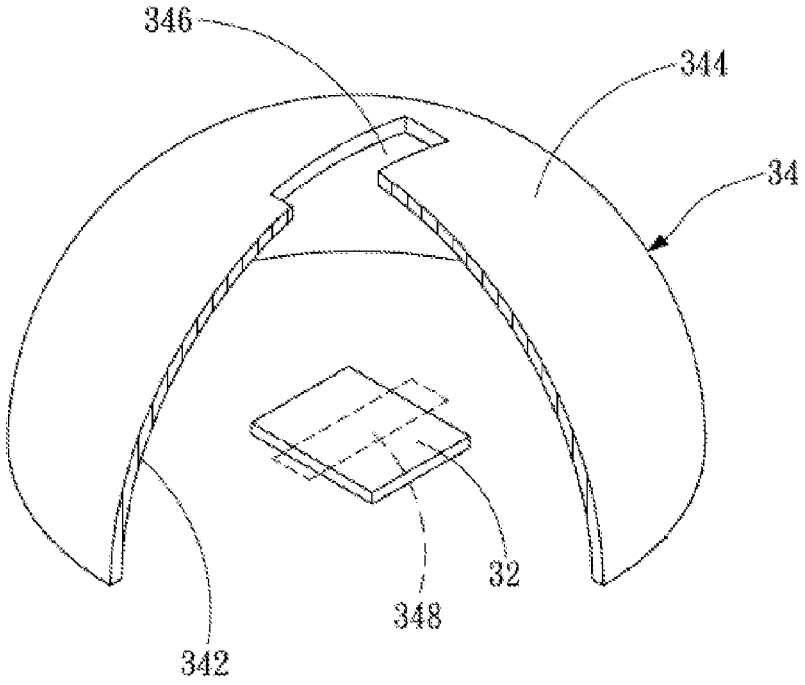
FIG. 9 is a schematic view of a fourth embodiment of the present invention.
Figure 10:
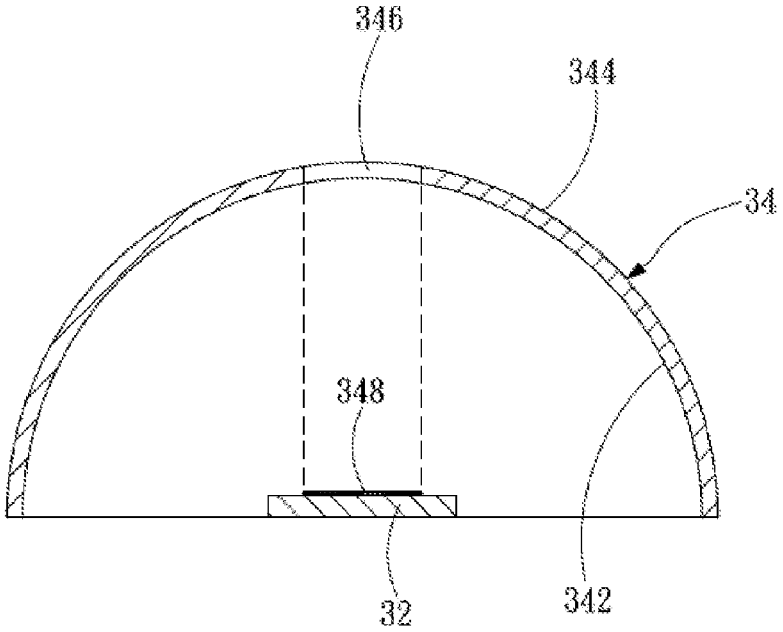
FIG. 10 is a side view of the fourth embodiment of the present invention.

FIGS. 9 and 10 are respectively a schematic view and a side view of a fourth embodiment of the present invention. Please refer to FIGS. 9 and 10, in which the fourth embodiment provides an antenna structure 3. The antenna structure includes a radiation unit 32 and a metal cover 34. The radiation unit 32 includes a feed part and a radiation part (not shown). The feed part is used for feeding electric signals. The radiation part is connected electrically to the feed part, so as to convert the electric signals into electromagnetic wave signals and send the electromagnetic wave signals. Alternatively, after the radiation part receives the electromagnetic wave signals, the feed part converts the electromagnetic wave signals into electric signals and outputs the electric signals. Here, the radiation unit 32 may further includes a grounding part (not shown), which is connected electrically to the radiation part, so as to be connected electrically to a grounding level. The radiation unit 32 is selected from a group consisting of a microstrip antenna, a slot antenna, a monopole antenna, a dipole antenna, a patch antenna, a loop antenna, a spiral antenna, a coaxial antenna, a chip antenna, and an array antenna.

The metal cover 34 includes a concave surface 342 and a convex surface 344. The concave surface 342 faces the radiation unit 32. The metal cover 34 is electrically isolated with the radiation unit 32, and is excited by the radiation unit 32 in the manner of energy coupling, so as to generate at least one resonance mode. The metal cover 34 includes a hole 346 penetrating the concave surface 342 and the convex surface 344. The metal cover 34 cannot be fed with any electric signals or be grounded. Here, the material of the metal cover 34 may be magnesium, aluminum, stainless steel, or an alloy thereof. The shape of the metal cover 34 in FIG. 9 is described as semi-spherical for convenience, which is not intended to limit the present invention.

When the radiation unit 32 radiates the electromagnetic wave signals, the metal cover 34 with the hole 346 couples the electromagnetic wave signals, and sends the electromagnetic wave signals with a radiation area larger than the radiation unit 32. The gain of the radiation unit 32 is thus increased. On the other hand, when receiving the electromagnetic wave signals, the metal cover 34 provides a large area to receive the electromagnetic wave signals. Therefore, the quality of communication of the radiation unit 32 is improved by the metal cover 34. The metal cover 34 couples the electromagnetic wave signals to the radiation unit 32 and converts the electromagnetic wave signals into electric signals. Here, the radiation unit 32 must be separated from the hole 346 of the metal cover 34 for a distance, so as to prevent that the two are too far away from each other to couple the electromagnetic wave signals; or the two are too close to each other such that the radiated electromagnetic wave signals has a strength exceeding the official standard.

The shape of the hole 346 may be a geometrical shape, such as circle and square, and may also be an irregular shape, for example, be designed to a shape of a trademark. The hole 346 cannot be connected to edges of the metal plate 16, that is, the hole 346 must be a hole with closed surroundings. The hole 346 is projected orthogonally to the radiation unit 32 to form a projection part 348, and the projection part 348 is at least partially overlapped with the radiation unit 32.

Figure 11:
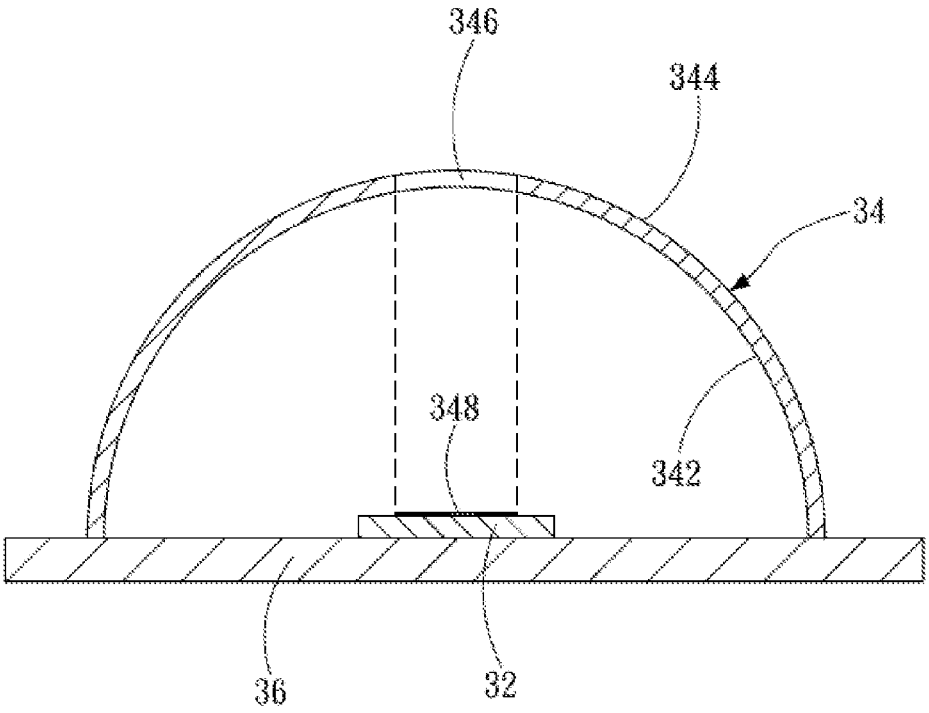
FIG. 11 is a schematic view of a fifth embodiment of the present invention.

FIG. 11 is a schematic view of a fifth embodiment of the present invention. Please refer to FIG. 11, similar to the antenna structure 3 according to the fourth embodiment of the present invention, an antenna structure according to the fifth embodiment of the present invention further includes a substrate 36, and a radiation unit 32 is disposed on the substrate 36. A metal cover 34 is connected to the substrate 36, but is electrically isolated with the substrate 36 or other electric signal lines on the substrate 36, so as to maintain the distance between the hole 346 and the radiation unit 32. Here, the metal cover 34 and the substrate 36 may be connected through welding, binding, locking with bolt.

Figure 12:
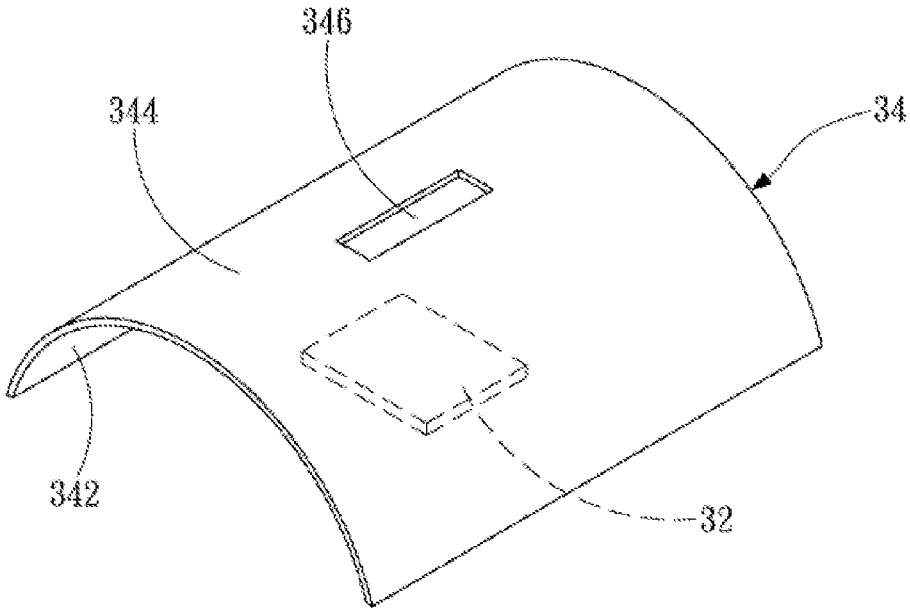
FIG. 12 is a schematic view of a sixth embodiment of the present invention.

FIG. 12 is a schematic view of a sixth embodiment of the present invention. Please refer to FIG. 12, similar to the antenna structure 3 according to the fourth embodiment of the present invention; a metal cover 34 according to the sixth embodiment of the present invention also includes a concave surface 342 and a convex surface 344. For example, the metal cover 34 may be in a form of cylindrical paraboloid. The concave surface 342 faces a radiation unit 32, and a metal cover 34 also includes a hole 346 penetrating the concave surface 342 and the convex surface 344. Furthermore, the antenna structure according to the sixth embodiment of the present invention may also further include a substrate 36, as described in the fourth embodiment of the present invention.

In view of the above, according to the present invention, the communication capability of the antenna is actually improved with a metal plate having a hole or a metal cover, and the metal plate is applied in the housing of electronic devices to improve the degree of freedom in appearance design of electronic devices.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An antenna structure, comprising:

a substrate;

a radiation unit, disposed on the substrate; and a metal plate, separated from the radiation unit for a distance, and electrically isolated with the radiation unit, wherein the metal plate is used to be excited by the radiation unit to generate at least one resonance mode, and the metal plate comprises a hole penetrating the metal plate and is not grounded or fed with electric signals.

2. The antenna structure according to claim 1, further comprising a fixing member, at least connected to one of the substrate and the metal plate, for maintaining the distance between the metal plate and the radiation unit.

3. The antenna structure according to claim 1, wherein the metal plate has at least one side plate extending.

4. The antenna structure according to claim 1, wherein the hole is projected orthogonally to a projection part of the radiation unit, and the projection part is at least partially overlapped with the radiation unit.

5. The antenna structure according to claim 1, wherein the radiation unit is selected from a group consisting of a microstrip antenna, a slot antenna, a monopole antenna, a dipole antenna, a patch antenna, a loop antenna, and an array antenna.

6. An antenna structure, comprising:

a radiation unit; and a metal cover, comprising a concave surface and a convex surface, wherein the concave surface faces the radiation unit, the metal cover is electrically isolated with the radiation unit and is used to be excited by the radiation unit to generate at least one resonance mode, and the metal cover comprises a hole penetrating the concave surface and the convex surface and is not grounded or fed with electric signals.

7. The antenna structure according to claim 6, further comprising a substrate, wherein the radiation unit is disposed on the substrate, and the metal cover is connected to the substrate.

8. The antenna structure according to claim 6, wherein the hole is projected orthogonally to a projection part of the radiation unit, and the projection part is at least partially overlapped with the radiation unit.

9. The antenna structure according to claim 6, wherein the radiation unit is selected from a group consisting of a microstrip antenna, a slot antenna, a monopole antenna, a dipole antenna, a patch antenna, a loop antenna, a spiral antenna, a coaxial antenna, a chip antenna, and an array antenna.

* * * * *